US007474272B2

(12) United States Patent
Lamoureux et al.

(10) Patent No.: US 7,474,272 B2
(45) Date of Patent: Jan. 6, 2009

(54) PARASITIC ELEMENT FOR HELICAL ANTENNA

(75) Inventors: Stéphane Lamoureux, Mirabel (CA); David McLaren, Beaconsfield (CA); Yves Gaudette, St-Lazarre (CA); Steve Larouche, St-Lazarre (CA); Jean Dallaire, Laval (CA)

(73) Assignee: MacDonald, Dettwiler and Associates Corporation, Ste-Anne-De-Bellevue (QC) (CA)

( * ) Notice: Subject to any disclaimer, the term of this patent is extended or adjusted under 35 U.S.C. 154(b) by 13 days.

(21) Appl. No.: 11/819,337

(22) Filed: Jun. 27, 2007

(65) Prior Publication Data

US 2008/0012787 A1 Jan. 17, 2008

Related U.S. Application Data

(60) Provisional application No. 60/816,891, filed on Jun. 28, 2006.

(51) Int. Cl.
*H01Q 1/36* (2006.01)

(52) U.S. Cl. ..... 343/895; 343/833

(58) Field of Classification Search ..... 343/895, 343/815, 817, 833, 834
See application file for complete search history.

(56) References Cited

U.S. PATENT DOCUMENTS

| | | | | |
|---|---|---|---|---|
| 3,015,823 | A * | 1/1962 | Pan | 343/895 |
| 3,491,361 | A * | 1/1970 | Campbell | 343/741 |
| 5,754,146 | A | 5/1998 | Knowles et al. | |
| 5,923,305 | A | 7/1999 | Sadler et al. | |
| 6,765,536 | B2 | 7/2004 | Phillips et al. | |
| 6,788,264 | B2 * | 9/2004 | Du | 343/725 |
| 2004/0257297 | A1 * | 12/2004 | Petros | 343/895 |

FOREIGN PATENT DOCUMENTS

JP 2001168630 A * 6/2001

* cited by examiner

*Primary Examiner*—Tho G Phan
(74) *Attorney, Agent, or Firm*—Equinox Protection; Franz Bonsang

(57) ABSTRACT

A parasitic element for a helical antenna having at least one helix conductor extending from a secured first longitudinal end of the antenna to an opposite free second longitudinal end thereof around an antenna major-axis. The parasitic element includes an electrically conductive ring located adjacent and spaced apart from the second end in a direction leading away from the first end with the ring axis being parallel to and substantially collinear with the antenna major-axis. The ring has an outer diameter substantially equal to the diameter of the helix conductor at the second end.

10 Claims, 7 Drawing Sheets

PARASITIC ELEMENT FOR HELICAL ANTENNA

CROSS-REFERENCE TO RELATED APPLICATION

Priority of U.S. Provisional Application for Patent Ser. No. 60/816,891, filed on Jun. 28, 2006, is hereby claimed.

FIELD OF THE INVENTION

The present invention relates to the field of antennas and is more particularly concerned with a parasitic element for helical antennas for improving the electric parameters thereof.

BACKGROUND OF THE INVENTION

It is well known in the art to use helical antennas mounted on a structure to allow communication with equipment located at a distance away. More specifically in the aerospace industry, helical antennas such as global coverage antennas are conventionally mounted on spacecraft structure to allow specific communications to and from the ground through a ground station on Earth. Accordingly, spacecraft mounted global coverage antennas are usually located on the conventionally called earth-facing panel of the spacecraft, but can also be mounted on side panels, depending on the respective antenna size and the available room on the panels.

With continuously increasing required antenna gain or other antenna parameters on spacecrafts, the global coverage antennas get larger, such as in the order of a few feet or meters, and depending on their signal frequency range. These large size antennas generate significant mechanical and electrical problems that need to be solved; especially when considering the complex and stringent mechanical and electrical environments the antennas encounter or need to survive. The solution to these problems often requires some trade-offs to be made with the antenna gain, or any other specific requirement the antennas need to meet.

The same concerns apply to large Earth-based helical antennas.

One of the solution known in the art to increase the signal gain of helical antennas is to add a capacitive parasitic element in the form of a tube inserted into the helix formed by the antenna conductor(s) and extending from the free end toward the opposite base end, as taught in U.S. Pat. No. 5,754,146 granted to Knowles et al. on May 19, 1998. Alternatively, the parasitic element can be in the form of a disjointed conductive helix surrounding the conductive helix. This type of parasitic element works generally well for relatively small size helical antennas and cannot realistically be considered for large antennas because of significant problems it would generate.

U.S. Pat. No. 5,923,305 granted to Sadler et al. on Jul. 13, 1999 discloses a dual-band helix antenna with parasitic element positioned either inside or outside of the helix, and may be parallel to the major-axis of the helix, or diagonally relative thereto (when located inside) so as to only be adjacent to two or more windings of the helix. The parasitic element allows the antenna to transmit and receive electrical signals in two widely separated frequency bands.

All known parasitic elements would be cumbersome in large scale applications by adding mass for the parasitic element and its support, and therefore complexity of the overall mechanical and/or electrical design of the antenna, especially if the antenna must be deployed in orbit to be functional.

Accordingly, there is a need for an improved parasitic element for helical antenna.

SUMMARY OF THE INVENTION

It is therefore a general object of the present invention to provide an improved parasitic element for helical antenna.

An advantage of the present invention is that the parasitic element improves the antenna electrical parameters from a few tenths of a decibel (dB) up to a few dBs, such as increasing the antenna gain, increasing the antenna cross-polarization, reducing the antenna back lobe (and PIM, passive intermodulation, risks in the antenna components located behind the back plane of the antenna), and the like.

Another advantage of the present invention is that the parasitic element is relatively small relative to the antenna helix, adding only little mass thereto, and is simple to implement.

A further advantage of the present invention is that the parasitic element can be weight relieved without significantly affecting its electrical efficiency.

Still another advantage of the present invention is that the parasitic element can serve as structural reinforcement for tie-down purposes.

Another advantage of the present invention is that the parasitic element helps reducing the overall length (or height) of the helical antenna, for a same antenna gain.

According to an aspect of the present invention there is provided a parasitic element for a helical antenna, the antenna including at least one helix conductor extending from a secured first longitudinal end of the antenna to an opposite free second longitudinal end thereof around an antenna major-axis, the parasitic element comprising an electrically conductive ring defining a ring axis and an inner and an outer wall thereof, the ring being adjacent and spaced apart from the second end in a direction leading away from the first end with the ring axis being substantially parallel to and collinear with the antenna major-axis, the ring outer wall having a diameter substantially equal to a diameter of the helix conductor at the second end.

Conveniently, the parasitic element includes a plurality of electrically conductive arms extending radially inwardly from the ring, the arms being generally angularly equidistantly spaced from each other, and preferably connecting to each other at the ring axis.

In one embodiment, the ring inner wall has a diameter being substantially smaller than the ring outer diameter, whereby the ring has an annular disc shape. Eventually, the ring inner diameter could be generally equal to zero such that the ring has a full disc shape.

Conveniently, the ring and the arms are of irregular cross-section so as to be weight relieved.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiment of the present invention will be herein described for indicative purpose and by no means as of limitation.

It is to be noted that although the following description essentially refers to a large global coverage antenna of a generally truncated conical shape, the parasitic element of the present invention can be used with different types and sizes of helical antennas having any number of conductive helices (single, dual, quadrafilar, etc.) of different shapes such as cylindrical, tapered (trunco-conical) and the like.

Figure 1:
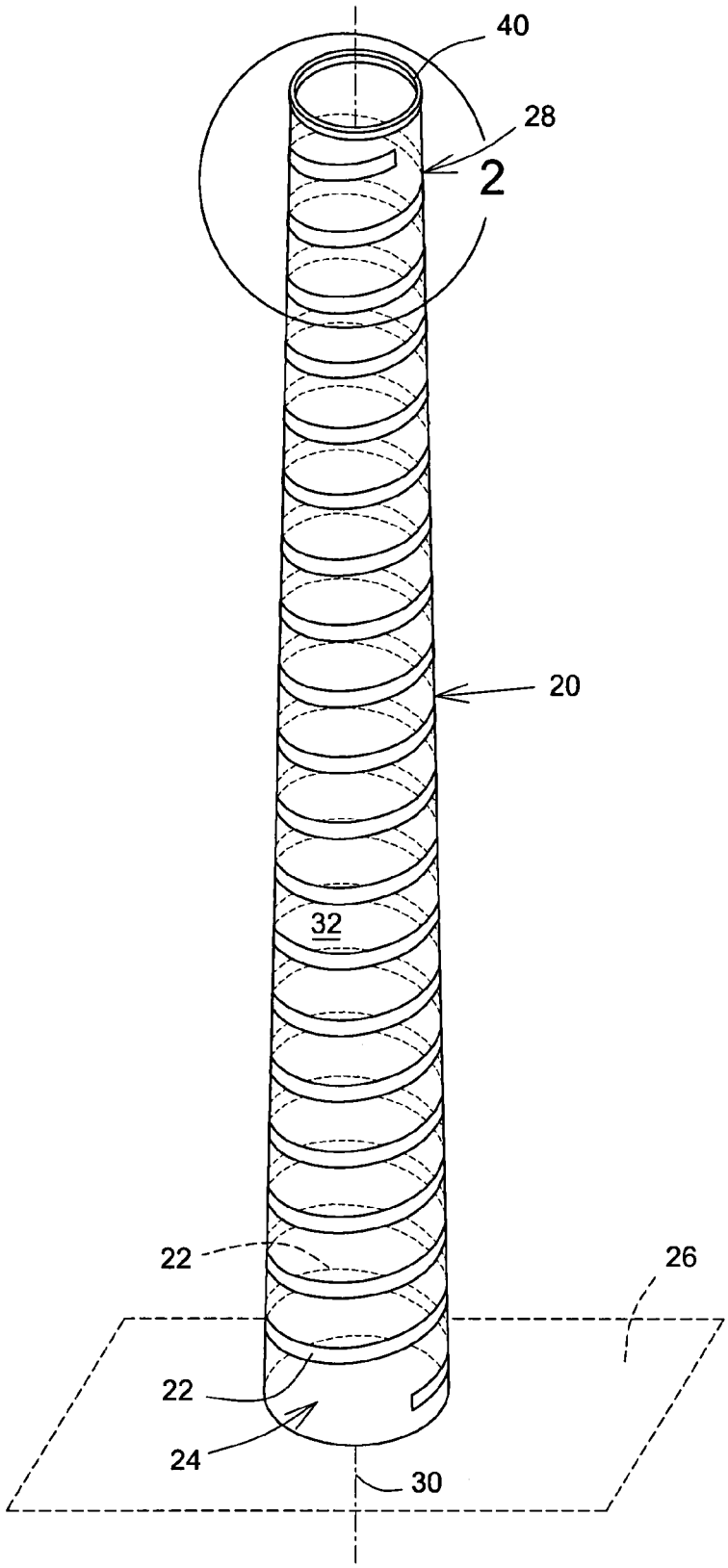
FIG. 1 is a simplified perspective view of a parasitic element in accordance with an embodiment of the present invention located above the helix conductor at the free end of a helical antenna.
Figure 2:
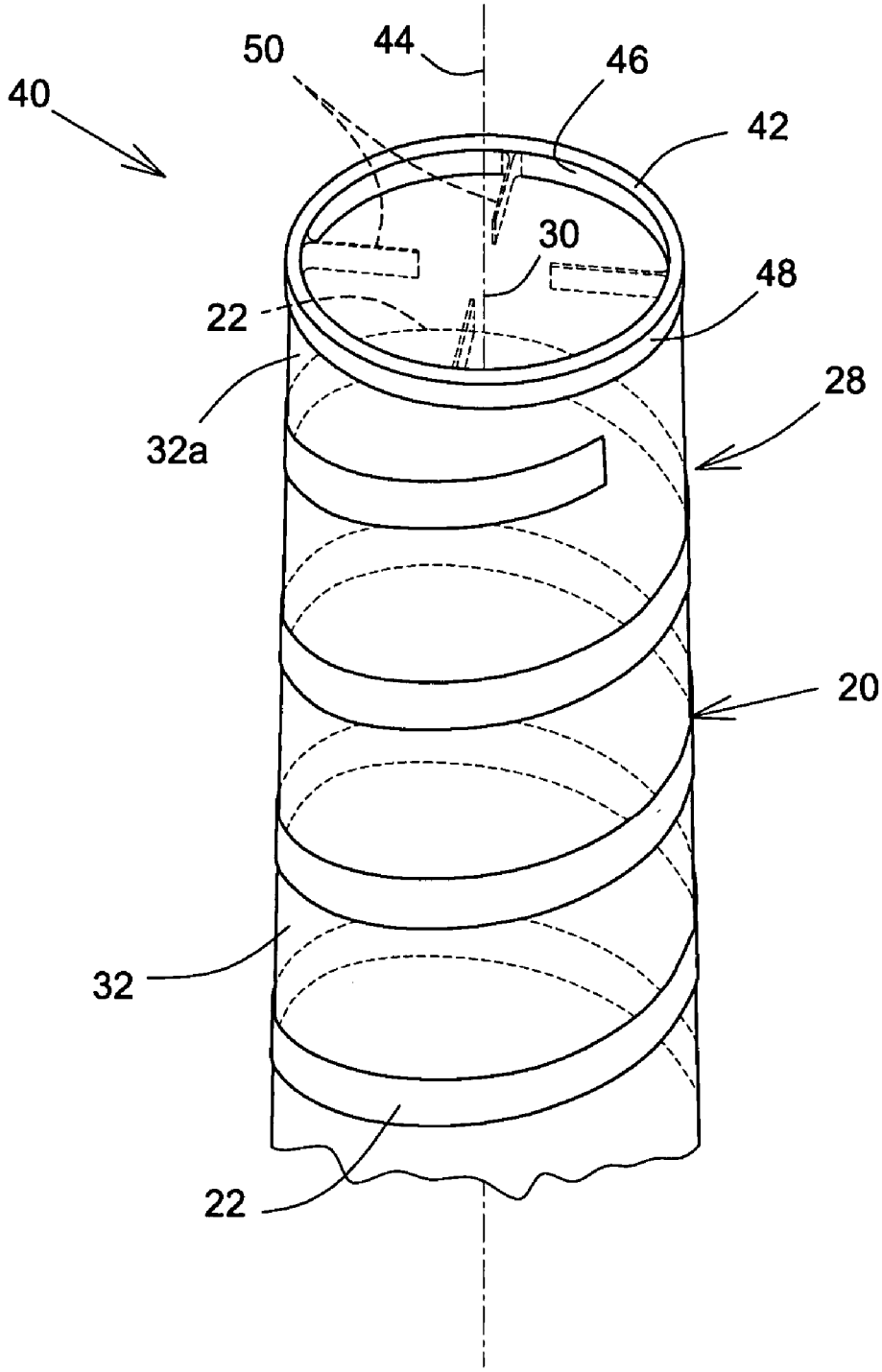
FIG. 2 is a simplified enlarged perspective view of the embodiment of FIG. 1.

Referring first to FIGS. 1 and 2, there is shown a parasitic element 40 in accordance with an embodiment of the present invention located above the helix conductor 22 of a helical antenna 20 that transmits and/or receives electrical signals. The antenna typically includes the helix conductor 22 that extends from a first lower longitudinal end 24 of the antenna generally secured to a back plane 26 or the like to an opposite free upper second longitudinal end 28 thereof and wound around an antenna major-axis 30. The helix 22 is typically mounted on by a helix support 32 made out of a dielectric material such as fiberglass, KEVLAR™ and the like. Although not illustrated in the figures, the helical antenna can also be made out of a deployable helix.

The parasitic element 40 includes an electrically conductive ring 42 that defines a ring axis 44. The ring 42 is generally continuous or closed, without any electrical discontinuities along its circumference or any open ends. The ring 42 that defines inner 46 and outer 48 walls thereof is generally adjacent and spaced apart from the upper end 28 in a direction leading away from the lower end 24 with the ring axis 44 being essentially parallel to and collinear with the antenna major-axis 30. The ring 42 is typically spaced a few millimeters, centimeters or inches from the electrically opened end 28 of the helix 22 such that it is electrically conductively decoupled therefrom. The ring 42 typically mounts on an axial extension 32*a* of the support 32 and has a diameter of its outer wall 48 substantially equal to the diameter of the helix 22 at the second end 28.

Figure 3:
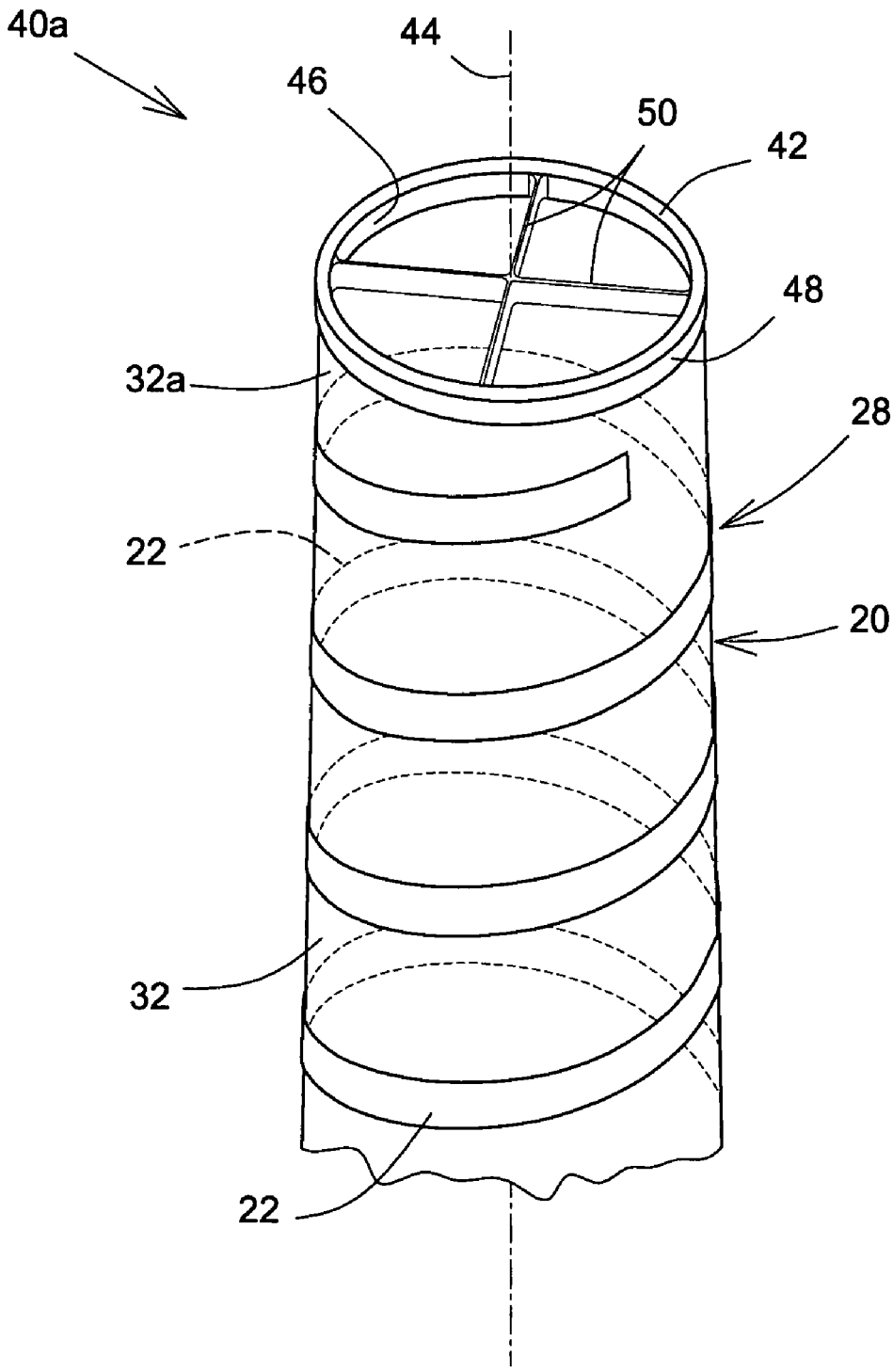
FIG. 3 is a view similar to FIG. 2 showing a parasitic element in accordance with another embodiment of the present invention.

Depending on the antenna requirements, the parasitic element 40*a* can also include a plurality of electrically conductive arms 50 extending radially inwardly from the ring inner wall 46 to essentially lay within the plane of the ring 42, as shown in FIG. 3. The arms 50 are generally angularly equidistantly spaced from each other and typically connect to each other at an intersection 52 on the ring axis 44 to form an internal cross or the like. Alternatively, some, or preferably all the arms 50 could end before reaching the ring axis 44 such that they do not touch each other, as schematically shown in dotted lines on FIG. 2, and still improve the axial-ratio or cross-polarization performance of the antenna. Typically, the arms 50, and the ring 42, show a generally symmetrical pattern about orthogonal axes within the ring plane, such as for example four (4) arms 50 spaced generally ninety degrees (90°) from each other, as depicted in FIG. 3.

Figure 4:
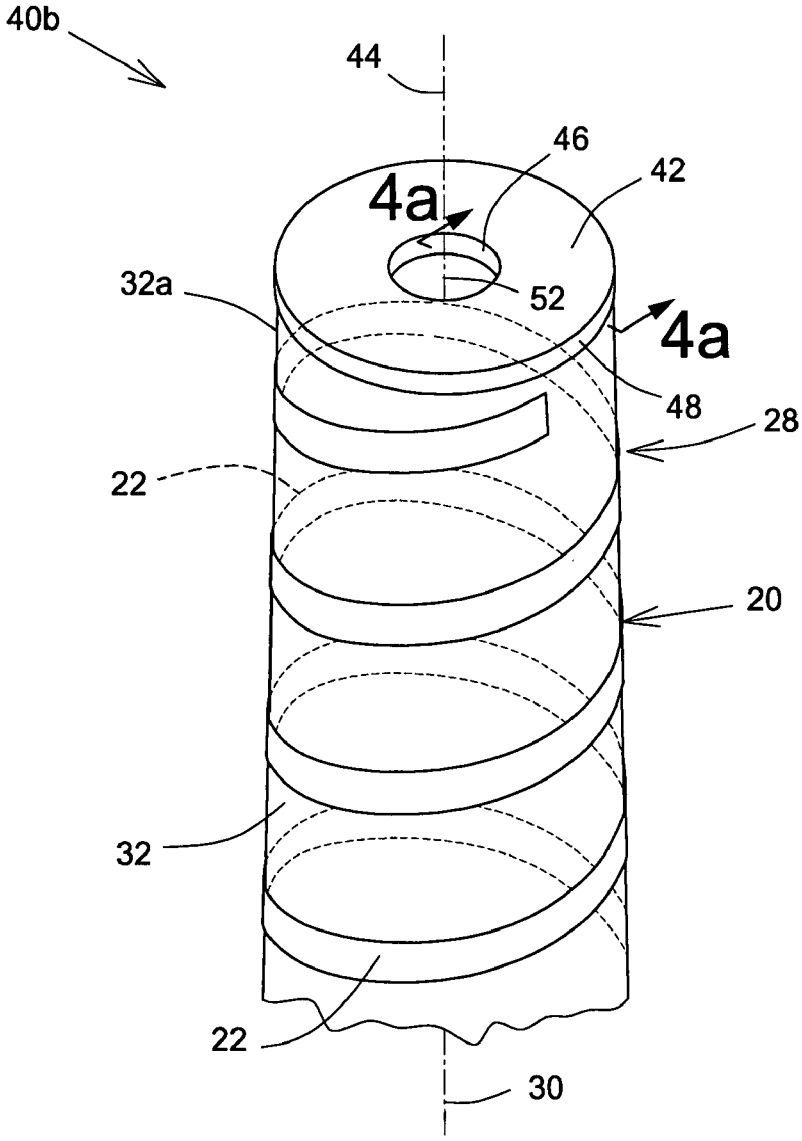
FIG. 4 is a view similar to FIG. 2 showing an annular disc parasitic element in accordance with the present invention.

As shown in FIG. 4, the outer 48 and especially the inner 46 radial walls of the ring could slightly radially protrude from the upper last winding of the helix 22 and form a small hollow or annular disc without significantly affecting the parasitic element efficiency on the antenna 20. Eventually, the disc could be full, with the inner wall diameter being generally equal to zero, and thereby hiding the arms, as shown in FIG. 4*b*. Concerning the outer wall 48 in general, the more its diameter increases relative to the diameter of the helix free end 28 the lower the tuning frequency of the antenna is, and the more its diameter decreases relative to the diameter of the helix free end 28 the more the parasitic element 40 efficiency reduces. Similarly, the height (axial dimension) of the ring 42 as well as its axial distance above the helix 22 are subject to variations based on the antenna parameter requirements that depend from the specific use of the antenna 20 and the transmitted/received electrical signal (frequency(ies), bandwidth, etc.).

As the electrical directivity or gain of the antenna 20 is dependent on the length or height of the antenna (of the helix 22), one skilled in the art would understand that the longer the antenna is the better gain is. Also, a longer antenna means more mass and more mechanical loads induced during movement of the antenna (especially when the antenna length is in the order of about two to three meters (2-3 m or 7-10 feet). The parasitic element 40 of the present invention allows increasing the electrical directivity on the antenna, by perturbing the electrical open circuit condition at the free end of the helix 22, or a reduction of the antenna length (height) for a same directivity gain, as further detailed hereinbelow. For example, in a satellite based helical antenna designed to provide global coverage of the Earth in the UHF frequency range, the addition of the parasitic element 40 would allow a reduction in antenna height of 10% to 15% for a similar antenna electrical directivity efficiency and a significant improvement in axial ratio, or cross-polarization performance, even compared with the longer antenna. The arms 50 further help to increase at least the cross-polarization performance of the antenna 20, as well as the tuning capabilities.

Although not illustrated in the Figures, the ring 42 and/or the arms 50 could include small protrusions (in any direction) and/or holes in any orientation to serve as either temporary or permanent tie-down points to help securing the antenna 20 and carry some mechanical loads there through, during transportation and/or spacecraft launch, for example.

Figure 4A:
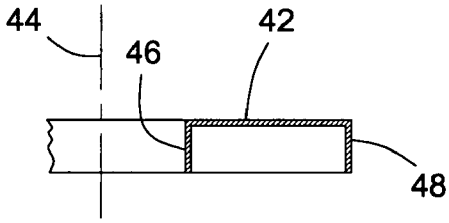
FIG. 4*a* is an enlarged broken section view taken along line 4*a*-4*a* of FIG. 4.
Figure 4B:
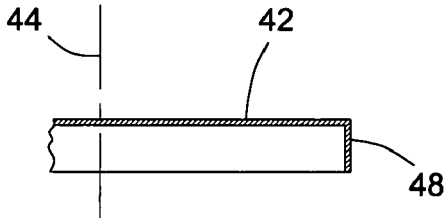
FIG. 4*b* is a view similar to FIG. 4*a*, showing a full disc parasitic element in accordance with the present invention.

Similarly, to minimize any mass impact due to the parasitic element 40, 40*a*, 40*b* (when mass in an important factor as in the aerospace industry, especially when large scale antennas are concerned), the ring 42 and/or the arms 50 could eventually be of non-uniform or irregular cross-section and weight relieved without affecting the efficiency of the parasitic element 40, 40*a*, 40*b*, as exemplified in FIG. 4*a*.

EXAMPLE

Figure 5:
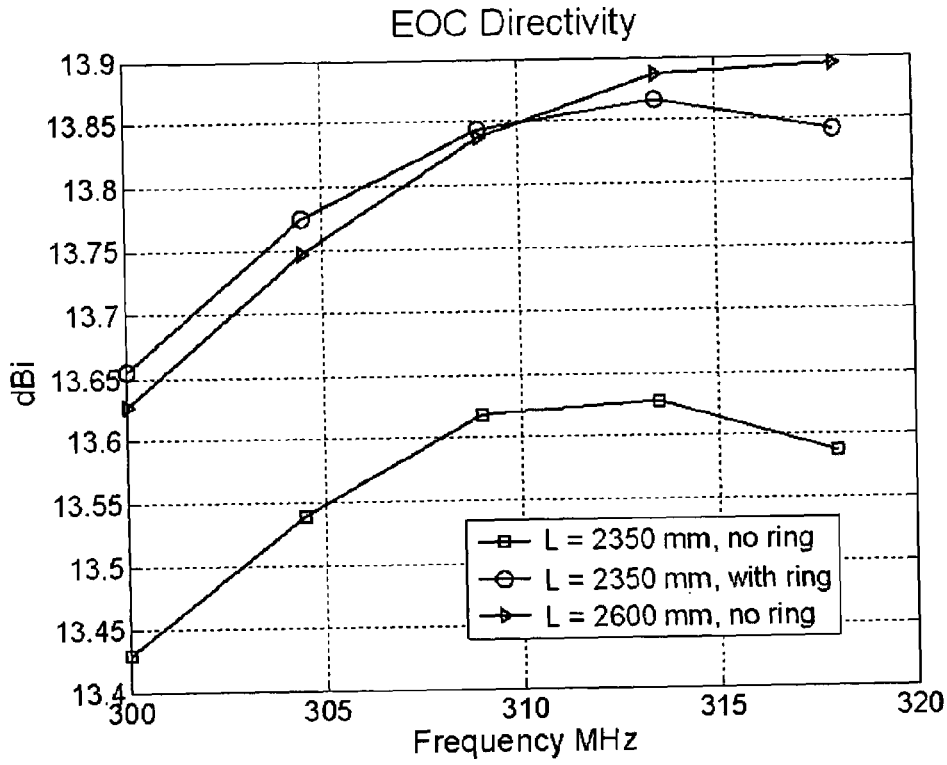
FIG. 5 is a graphical antenna simulation results, showing the Edge-of-Coverage directivity antenna parameter of a 2350 mm long antenna with and without a parasitic element of FIG. 3 and a 2600 mm long antenna without parasitic element.
Figure 6:
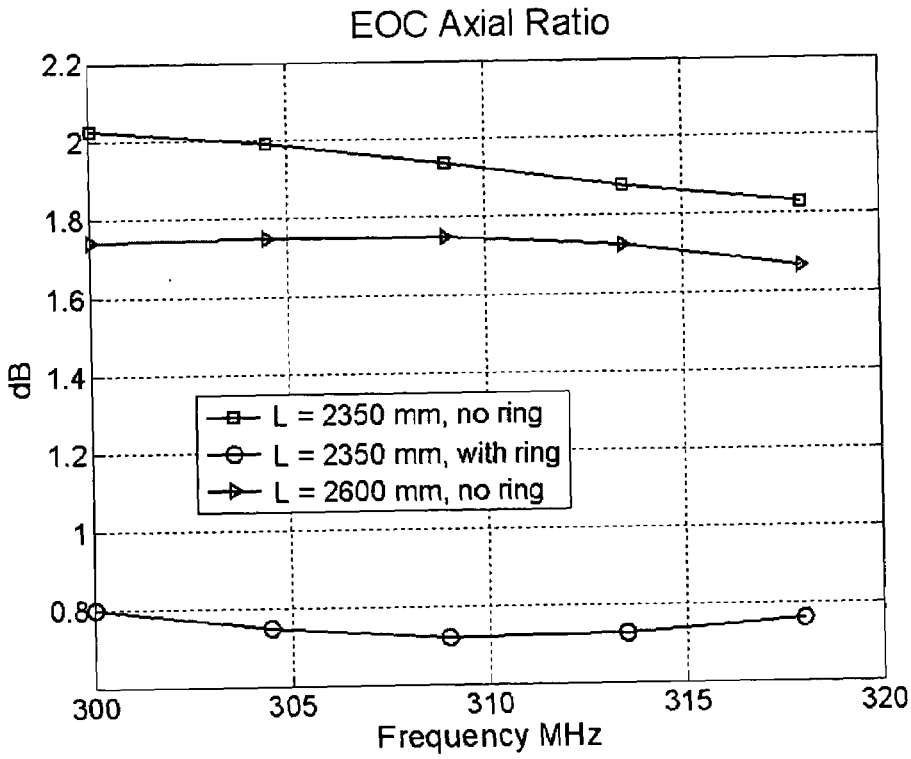
FIG. 6 is a graphical antenna simulation results similar to FIG. 5, showing the Edge-of-Coverage axial ratio antenna parameter of the antennas.

The following example is provided for illustrative purposes and by no means as of limitation. This example describes in details the impact of the parasitic element 40*a* on the helical antenna performance. The selected configuration is a 2350 mm (7 feet and 9 inches) long helical antenna 20 mounted into a ground cup. Antenna performances are evaluated for a 9-degree coverage (Edge-of-Coverage, or EOC). The helical antenna 20 provides a high gain axial mode. FIGS. 5 and 6 show the EOC Directivity and Axial Ratio improvements due to the parasitic element 40*a* of the selected antenna relative to the helix alone. FIG. 5 shows that, in order to obtain the same directivity without parasitic element 40*a*, the antenna length must be increased from 2350 mm to about 2600 mm (8 feet and 4 inches), more than 10%. Further, FIG. 6 shows that the parasitic element 40*a* improves the axial ratio by more than about 1 dB (Decibel). Furthermore, even the 2600 mm long antenna without parasitic element 40*a* has an axial ratio about 1 dB worst than the 2350 mm long antenna with the parasitic element 40*a*.

Figure 7A:
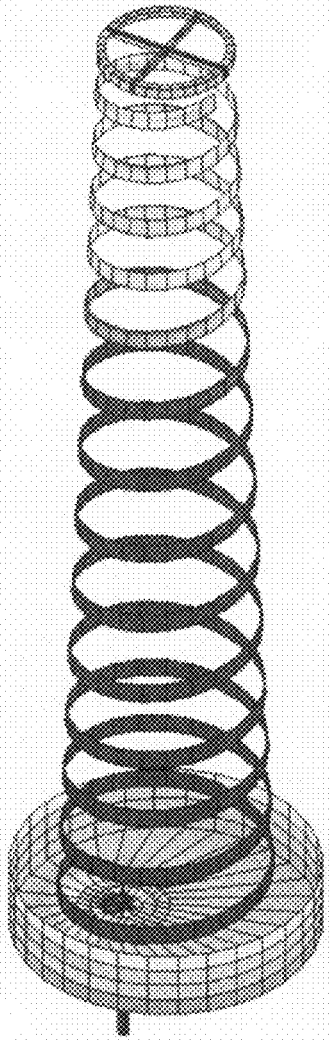
FIGS. 7*a* and 7*b* are pictorial antenna simulation results, showing the electrical current mapping on the helix of a helical antenna with and without the parasitic element of FIG. 3, respectively.
Figure 7B:
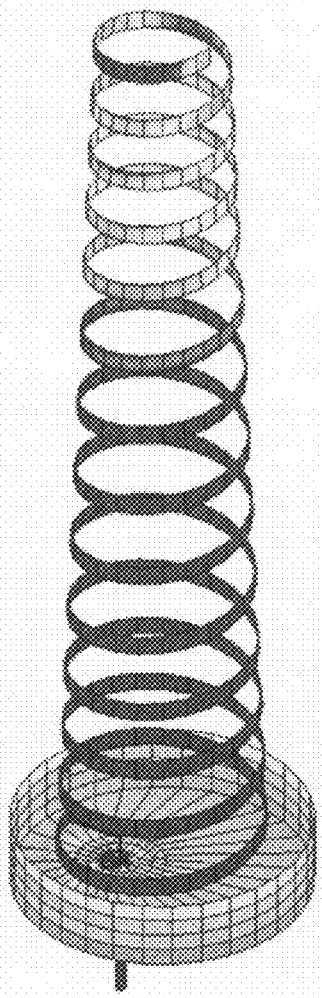
Figure 8A:
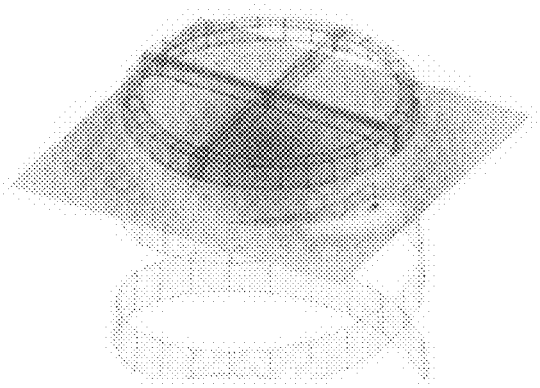
FIGS. 8*a* and 8*b* are pictorial antenna simulation results, showing the electrical field distribution on a plane passing through the free end of the helix of a helical antenna with and without the parasitic element of FIG. 3, respectively.
Figure 8B:
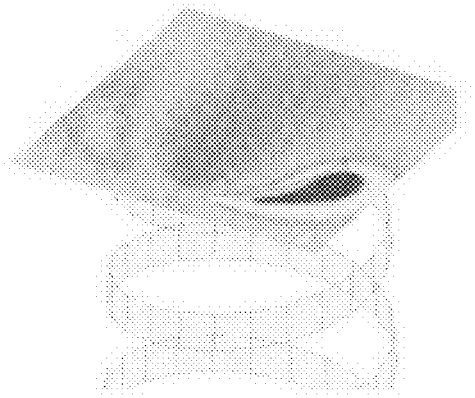

The improvement of performance comes from the capacitive coupling between the parasitic element 40*a* and the free end 28 of the helical antenna 20. The electrical load provided by the parasitic element 40*a* changes the impedance at the end of the helix 22 and reduces the impact of the electrical open circuit. This has the effect of reducing the standing electromagnetic wave at the free end 28 of the helix 22, as shown by the electrical current shaded mapping (dark pattern represents strong current while light pattern represents weak current) of FIGS. 7*a* and 7*b*, with and without the parasitic element 40*a*, respectively. FIGS. 8*a* and 8*b* show the electrical field on a plane passing through the free end 28 of the helix 22 and substantially perpendicular to its axis 30, with and without the parasitic element 40*a*, respectively. The parasitic element 40*a* clearly reduces the field strength at the free end 28 of the helix, which again confirms that the parasitic element 40*a* reduces the open circuit effect.

Figure 9A:
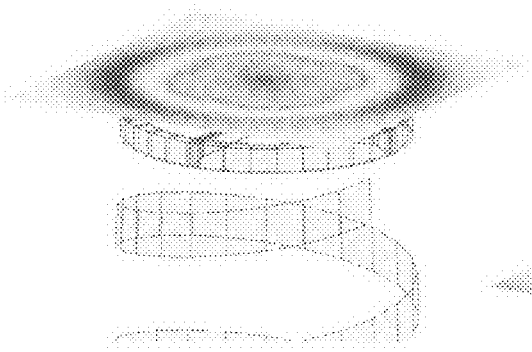
FIGS. 9*a* and 9*b* are pictorial antenna simulation results, showing the electrical field distribution on a plane above the free end of the helix of a helical antenna with and without the parasitic element of FIG. 3, respectively.
Figure 9B:
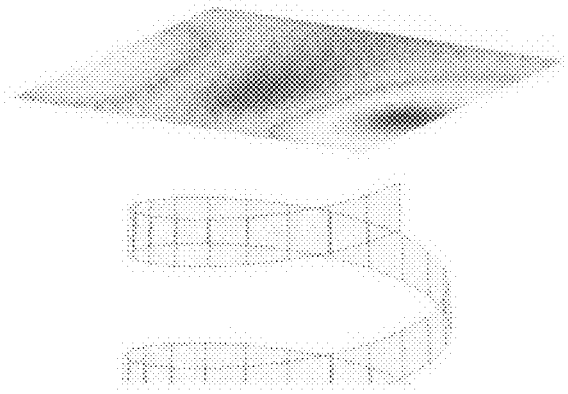

A smoother current distribution has a direct impact on the electrical field distribution on a plane perpendicular to the antenna axis 30 around the antenna free end 28 with the parasitic element 40*a*, as shown by FIG. 9*a*. The parasitic element 40*a* makes the electrical field almost symmetrical just above the antenna 20, as compared to the standard helical antenna without the parasitic element 40*a* shown in FIG. 9*b* where the field is stronger around the tip of the helix 22.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A parasitic element for a helical antenna, the antenna including at least one helix conductor extending from a secured first longitudinal end of the antenna to an opposite free second longitudinal end thereof around an antenna major-axis, the parasitic element comprising an electrically conductive ring defining a ring axis and an inner and an outer wall thereof, the ring being adjacent and spaced apart from the second end in a direction leading away from the first end with the ring axis being substantially parallel to and collinear with the antenna major-axis, the ring outer wall having a diameter substantially equal to a diameter of the helix conductor at the second end.

2. The parasitic element of claim 1, further including a plurality of electrically conductive arms extending radially inwardly from the ring inner wall, the arms being generally angularly equidistantly spaced from each other.

3. The parasitic element of claim 2, wherein the arms connect to each other adjacent the ring axis.

4. The parasitic element of claim 3, wherein said ring and said arms are of irregular cross-section so as to be weight relieved.

5. The parasitic element of claim 1, wherein said ring inner wall has a diameter being substantially smaller than the ring outer diameter, whereby said ring has an annular disc shape.

6. The parasitic element of claim 5, further including a plurality of electrically conductive arms extending radially inwardly from the ring inner wall, the arms being generally angularly equidistantly spaced from each other.

7. The parasitic element of claim 6, wherein the arms connect to each other adjacent the ring axis.

8. The parasitic element of claim 5, wherein said ring inner diameter is generally equal to zero, whereby said ring has a full disc shape.

9. The parasitic element of claim 5, wherein said ring is of irregular cross-section so as to be weight relieved.

10. The parasitic element of claim 1, wherein said ring is of irregular cross-section so as to be weight relieved.

* * * * *